US008807606B2

(12) United States Patent
Ross et al.

(10) Patent No.: US 8,807,606 B2
(45) Date of Patent: Aug. 19, 2014

(54) ELECTRIC STRIKE

(75) Inventors: Keith James Ross, Knoxfield (AU); Geoffrey Howard Ross, Knoxfield (AU); Beverley Ann Ross, Knoxfield (AU)

(73) Assignee: K.J. Ross Security Locks Pty. Ltd., Knoxfield (AU)

( * ) Notice: Subject to any disclaimer, the term of this patent is extended or adjusted under 35 U.S.C. 154(b) by 68 days.

(21) Appl. No.: 13/276,915

(22) Filed: Oct. 19, 2011

(65) Prior Publication Data

US 2012/0091739 A1 Apr. 19, 2012

(30) Foreign Application Priority Data

Oct. 19, 2010 (AU) ..... 2010904670

(51) Int. Cl.
*E05C 3/16* (2006.01)

(52) U.S. Cl.
USPC ..... 292/220; 292/341.15; 292/341.16; 292/341.17

(58) Field of Classification Search
CPC . G06F 1/1679; E05B 65/006; E05B 47/0047; E05C 19/16
USPC ..... 292/201, 220, 251.5, 341.15, 341.16, 292/341.17, 340, 1; 70/275, 277, 432, 441, 70/443
See application file for complete search history.

(56) References Cited

U.S. PATENT DOCUMENTS 3,861,727 A * 1/1975 Froerup et al. ..... 292/341.16
4,917,425 A * 4/1990 Logas ..... 292/341.16
5,492,382 A 2/1996 McBride et al.
6,082,791 A * 7/2000 Frolov et al. ..... 292/341.16
6,595,563 B2 * 7/2003 Kiernan ..... 292/341.16
6,595,564 B1 * 7/2003 Hanchett et al. ..... 292/341.16
6,634,685 B2 10/2003 Herron et al.
6,874,830 B2 * 4/2005 Bashford ..... 292/341.16
6,935,663 B2 * 8/2005 Schildwachter et al. 292/341.16
7,144,053 B2 * 12/2006 Bashford ..... 292/341.16
7,472,934 B2 1/2009 Burke et al.
7,669,902 B2 * 3/2010 Orbeta ..... 292/340

FOREIGN PATENT DOCUMENTS

| | | |
|---|---|---|
| EP | 0239341 | 9/1987 |
| EP | 1091060 | 4/2001 |
| GB | 2280218 | 1/1995 |
| NZ | 235055 | 3/1993 |
| NZ | 520857 | 5/2005 |
| WO | 2004015231 | 2/2004 |

* cited by examiner

*Primary Examiner* — Kristina Fulton
*Assistant Examiner* — Nathan Cumar
(74) *Attorney, Agent, or Firm* — David D. Brush; Westman, Champlin & Koehler, P.A.

(57) ABSTRACT

An electrically powered lock, e.g. an electric strike, includes a housing and a latch mounted with respect to the housing so as to be pivotable about a latch axis between an open position and a locking position. The latch has a latch face and a segment that projects laterally of both the latch axis and the latch face. A locking element is mounted for rotation about a lock axis normal to but offset from the latch axis for selectively blocking the laterally projecting segment to hold the latch in the locking position or allowing the latch to move to the open position to thereby place the lock respectively in a locked condition or an unlocked condition. An electrically powered driver is disposed within the housing laterally of the latch axis actuable in a direction generally parallel to the latch axis for effecting rotation of the locking element.

35 Claims, 5 Drawing Sheets

ELECTRIC STRIKE

CROSS-REFERENCE TO RELATED APPLICATIONS

None.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

This disclosure relates to an electrically powered lock and, in particular, but not exclusively, to an electric strike lock, commonly known as an electric strike.

BACKGROUND OF THE DISCLOSURE

Electric strikes generally comprise a moveable latch, often also called a keeper, which defines a recess in which a bolt connected to a door can locate in order to hold the door in a locked or closed position. The latch is moveable from a locking position in which the bolt is trapped in the recess to lock the door, to an open position in which the bolt is able to leave the recess to enable the door to open, e.g. because the latch can be pushed aside by the bolt. The lock includes an electronic driver such as a solenoid which is actuable to hold the latch in the locking position and is selectively de-activated to allow the latch to move to the open position to enable the door to open.

Electric strikes, as well as other types of electronic locks, are sometimes required to operate in a failsafe mode and sometimes required to operate in a fail-secure mode. In the failsafe mode, power must be applied to the lock in order to place the lock into the locking condition. This means that if there is a power failure and no power is supplied to the lock, the lock is automatically placed in an open position. The associated door will therefore be able to open in the event of a power failure so that people can escape from the building. This is important in many environments because during emergency situations power is sometimes disrupted, and if the door is maintained locked when power is disrupted, the door may not be able to open, thereby trapping people in a building or other dwelling, which may have disastrous consequences. However, in other applications, a lock may be required to operate in a fail-secure mode, which requires power to be supplied to the lock in order to unlock the lock. In that case, in the event of a power failure or power disruption to the lock, the lock is maintained in a closed or locked condition.

Generally locks are specifically made to either operate in a failsafe mode or fail-secure mode and different componentry and setups are employed to provide a failsafe lock and a fail-secure lock. This increases the amount of componentry that a lock manufacturer may need to have in order to produce both types of locks, and prevents easy conversion of a failsafe lock into a fail-secure lock, and vice versa.

Reference to any prior art in the specification is not, and should not be taken as, an acknowledgment or any form of suggestion that this prior art forms part of the common general knowledge in Australia or any other jurisdiction or that this prior art could reasonably be expected to be ascertained, understood and regarded as relevant by a person skilled in the art.

SUMMARY

A first aspect of the disclosure relates to an electrically powered lock comprising: a housing;

a latch mounted with respect to the housing so as to be pivotable about a latch axis between an open position and a locking position, and having a latch face and a segment that projects laterally of both the latch axis and the latch face;

a locking element mounted for rotation about a lock axis normal to but offset from the latch axis for selectively blocking said laterally projecting segment to hold the latch in said locking position or allowing the latch to move to said open position to thereby place the lock respectively in a locked condition or an unlocked condition; and an electrically powered driver disposed within said housing laterally of said latch axis actuable in a direction generally parallel to the latch axis for effecting said rotation of the locking element.

Preferably, the lock further includes a coupling member operatively between the locking element and the driver, which coupling member is positionable in a first position or a second position, so that when the coupling member is in the first position the lock operates in a failsafe mode, and when in the second position the lock operates in a fail-secure mode.

Preferably, the electrically powered driver includes a shaft aligned along a driver axis generally parallel to the latch axis, and actuable for moving the locking element by being axially displaceable.

Advantageously, for optimum compactness, the projecting segment of the latch lies axially beyond the shaft of the electrically powered driver when the shaft is extended and the latch is in its locking position, and furthermore the rotatable locking element is behind or below the shaft relative to the plane of the latch axis and driver axis and has a recess that registers with the projecting segment of the latch when allowing the latch to move to its open position but is rotatably displaceable to a position in which the locking element holds the latch in the locking position by blocking movement of the projecting segment.

With this preferred arrangement, a failsafe lock or a fail-secure lock can be formed from the same componentry by merely locating the coupling member in the required one or other position to produce the locking mode required. Thus, during manufacture of the lock, the lock can be made as a failsafe lock or a fail-secure lock by simply locating the coupling member in the required one of the two positions. Furthermore, if it is desired to convert the lock from a failsafe mode to a fail-secure mode, or vice versa, this can be done by changing the position of the coupling member between the first and second positions to change the mode of the lock. Thus, a failsafe lock and fail-secure lock can be formed from substantially the same componentry and the lock can be converted from one mode to another if desired.

The alternately positionable coupling member may comprise an element disposed between said shaft and said rotatable locking element in engagement with an axially transverse projection on the shaft and with one or more outstanding formations on the locking element, wherein the aforesaid first position and second position of the coupling member are substantially opposite orientations of the coupling member with respect to the aforesaid driver axis.

A second aspect of the disclosure provides an electrically powered lock comprising:

a housing;

a latch pivotable about a latch axis between an open position and a locking position;

an electrically powered driver including a driver shaft aligned along a driver axis generally parallel to the latch axis, which driver is disposed within said housing laterally of said latch axis;

a locking element mounted for rotation about a lock axis normal to but offset from the latch axis for selectively holding the latch in said locking position or allowing the latch to move to said open position to thereby place the lock respectively in a locked condition or an unlocked condition; and a coupling member disposed between said shaft and said locking element in engagement with an axially transverse projection on the shaft and with one or more outstanding formations on the locking element, which coupling member is positionable in a first position or a second position comprising substantially opposite orientations of the coupling member with respect to the driver axis, so that when the coupling means is in the first position the lock operates in a failsafe mode, and when in the second position the lock operates in a fail-secure mode;

wherein said driver is actuable along the driver axis for effecting said rotation of the locking element via said coupling member.

In an advantageous embodiment of either aspect of the disclosure, the electrically powered lock is an electric strike. In a preferred arrangement, the electrically powered driver is a solenoid and the aforementioned shaft its armature. Biasing means, for example a helical compression spring about the shaft, is provided for biasing the shaft to an extended position so that activation of the solenoid actuates the shaft by retracting it from this position.

The latch is preferably pivotably mounted to the housing by a hinge pin extending the full length of the latch adjacent one edge of the latch face. The latch will typically be biased to the locking position, for example by way of a helical torsion spring on the hinge pin.

Advantageously, the housing is dimensioned, and includes spaced flanges with appropriately located screw holes, for mounting the lock as an electric strike of standard sized non-electric strike dimensions. Preferably, the electrically powered driver, the locking element and the coupling member are disposed within a chamber hidden when the lock is viewed from within a doorway adjacent the jamb in which the strike is mounted.

As used herein, except where the context requires otherwise, the term "comprise" and variations of the term, such as "comprising", "comprises" and "comprised", are not intended to exclude further additives, components, integers or steps.

BRIEF DESCRIPTION OF THE DRAWINGS

The disclosure will now be further described, by way of example only, with reference to the accompanying drawings, in which.

DETAILED DESCRIPTION OF ILLUSTRATIVE EMBODIMENTS

Figure 1:
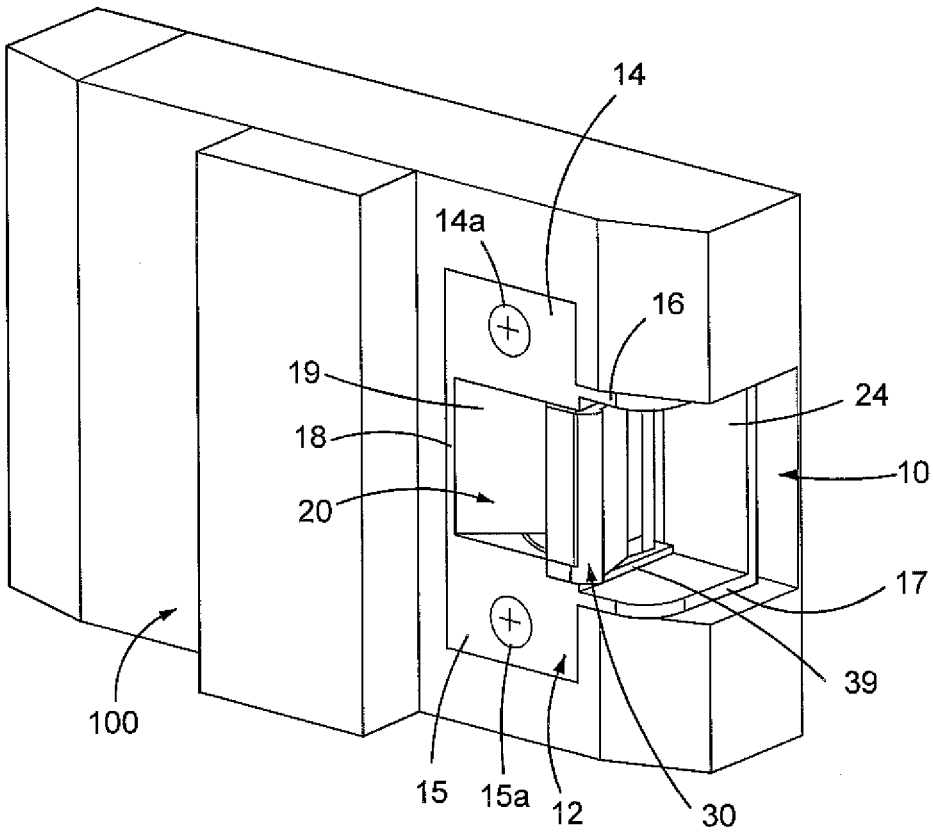
FIG. 1 is a front isometric view of an electric strike according to a first embodiment of the disclosure fitted to a door jamb.

The illustrated electric strike 10 includes an outer housing 12 with mounting flanges 14,15 at top and bottom, a pivotally mounted latch or keeper 30, an electrically powered driver in the form of a solenoid driver 50 with an axially translatable armature 52, and a mechanism 70 by which the solenoid driver 50 may selectively control the functioning of latch 30 in either a failsafe or fail-secure mode. Electrical leads to provide electrical power to solenoid driver 50, and/or to control its operation, are not shown.

Housing 12 is preferably a single metal casting that includes a top wall 16 and bottom wall 17 joined by an inner end wall 18 and an internal inclined but off-diagonal wall 19 that divides the space between top and bottom walls 16,17 into an outer tapered recess 20 open at the front of the housing, and an interior chamber 22 in which solenoid driver 50 and mechanism 70 are mounted. The otherwise open rear of the housing is closed by a cover plate (not visible). Flanges 14,15 are respectively upstanding and dependent from the front edges of top and bottom walls 16,17 for part of the width of the housing, while the remainder of the width is open at front and inner end but closed at the rear by a strike or guard plate 24 for latch 30 when open. Plate 24 links the rear edges of top and bottom wall 16,17.

In accordance with a preferred embodiment, flanges 14,15, and their screw holes 14*a*,15*a*, are positioned to be retrofitted to a jamb 100 of a door frame (FIG. 1) in place of a standard non-electric door strike. This is facilitated by the compactness of the layout within housing 12. In a wooden door frame, some additional depth of the centre cavity may be required. For a metal door frame, housing 12 will simply fit the cut-out already present.

Figure 5:
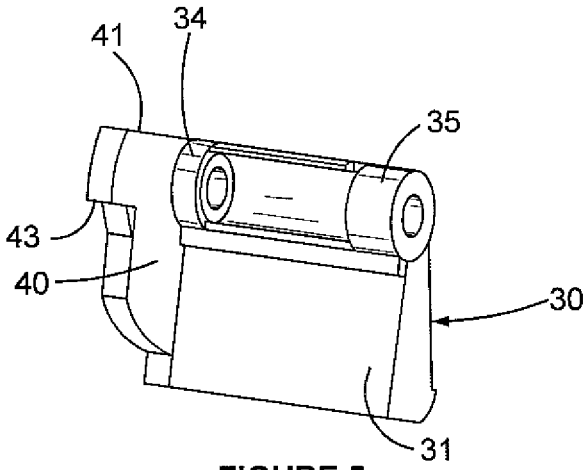
FIG. 5 is an isometric view of the latch or keeper.
Figure 6:
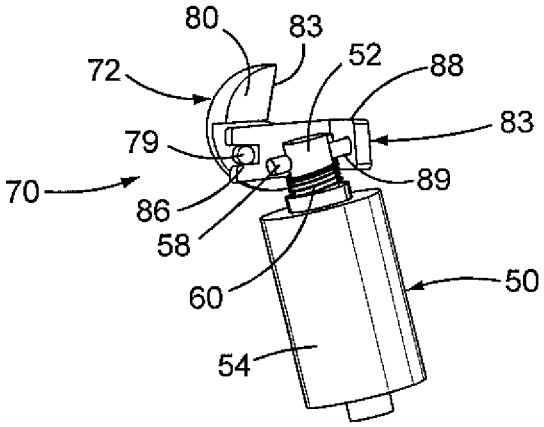
FIGS. 6 and 7 are fragmentary three-dimensional views corresponding to FIGS. 2 and 3 depicting the operational inter-engagement between the solenoid driver, the coupling member, and the rotatable locking element.
Figure 7:
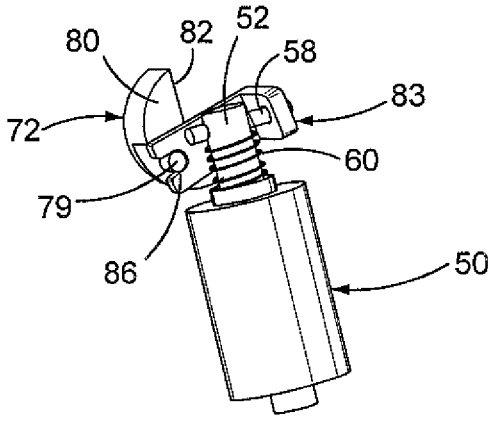

Latch 30 has a latch face 31 (FIG. 5), is disposed at the outer side of tapered recess 20, and is pivotally mounted on a hinge pin 32 by means of spaced integral sleeve portions 34,35 at top and bottom of one vertical edge of the latch. Hinge pin 32 extends the full length of the latch adjacent that edge and mounts a helical torsional spring 36 that biases the latch to the locking position shown in FIG. 1 in which it closes tapered recess 20. This locking position is determined by a stop shoulder at the inner edge of flange 14. If the latch is locked in this position, it prevents release of a lock bolt (from the adjacent door) retained in recess 20: latch face 31 provides a stop face against which the lock bolt abuts. If the latch 30 is not locked in this position, the latch 30 may be pivoted back against spring 36 about the axis 33 of pin 32, which is therefore the latch axis, until it strikes plate 24, to allow withdrawal of the bolt and thereby opening of the door.

Hinge pin 32 is retained by a grub screw 38 in a recess seat or aperture formed in a thicker segment 39 of bottom housing wall 17. Latch 30 includes an integral projecting segment in the form of a wing plate 40 (best seen in FIG. 5) at its top rear that in the biased locking position of the latch has a rear edge 41 adjacent the rear cover plate and extends through a slot 19*a* in inclined wall 19 into the upper end of chamber 22. Segment 40 projects laterally of both the latch axis 33 and the latch face 31.

Solenoid driver 50 has a generally cylindrical casing 54 for a coil (not visible) about axially translatable armature 52. Casing 54 is retained on a support plate 55 between thicker wall segment 39 and a pair of outstanding intermediate partition elements 56. Armature 52 has a transverse cross-pin 58 secured in a diametral bore 59 of the armature adjacent its outer end, so as to project substantially further laterally of the armature at one side than the other. The armature 52 is rotatable (e.g. by hand) about its axis 53, which is the driver axis, to selectively vary the direction of projection of cross-pin 58, for purposes to be explained shortly. Cross-pin 58 also provides an outer stop for a helical compression spring 60 retained on armature 52. Spring 60 biases armature 52 outwardly of the solenoid casing 54—the inner stop for the spring is an end shoulder on casing 54. Solenoid 50 is powered or activated to draw armature 52 inwardly against spring 60 and to control the operation of latch 30 as will be further explained.

Figure 2:
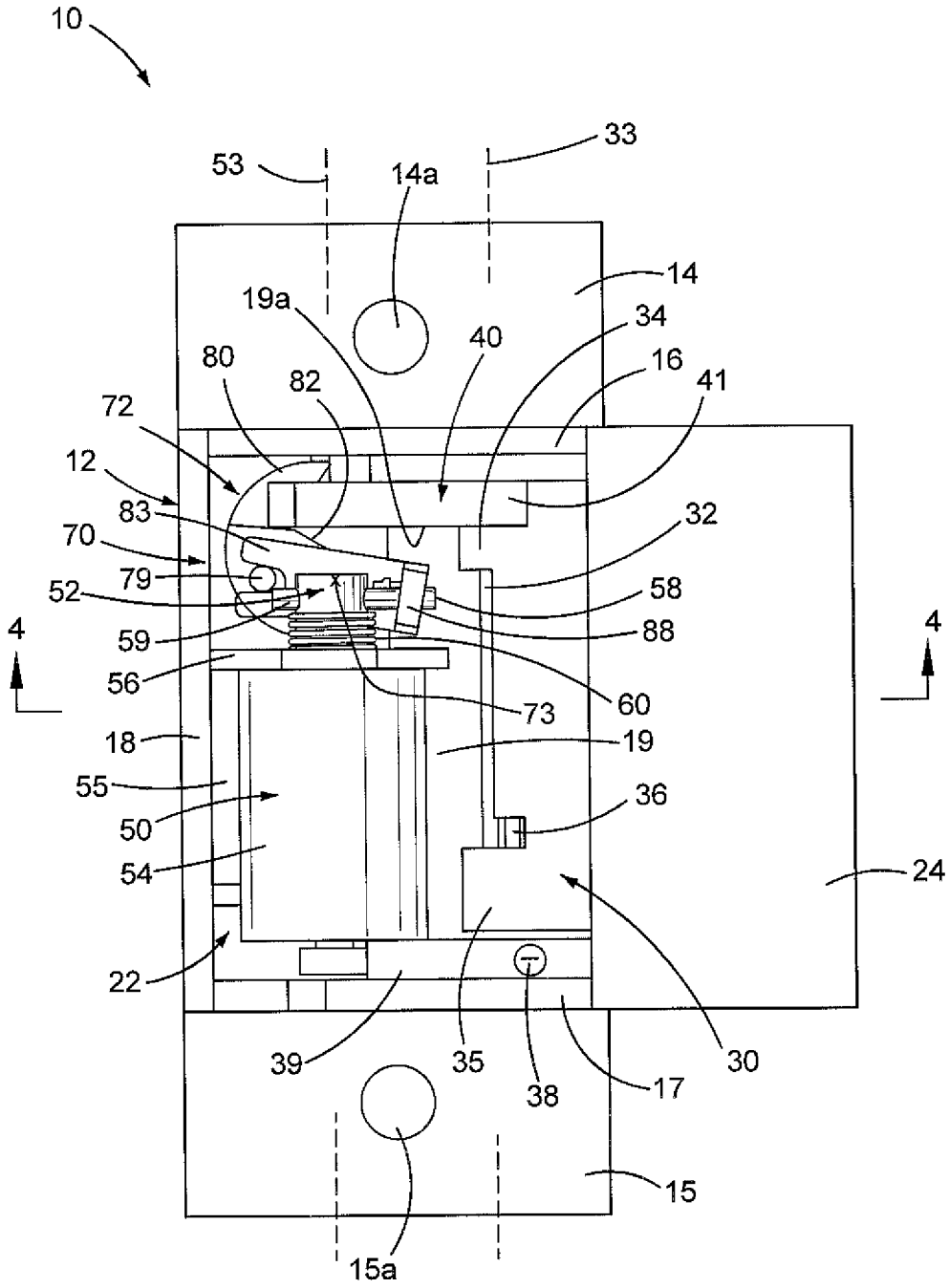
FIG. 2 is a rear elevation of the electric strike depicted in FIG. 1, with the back cover removed and the mechanism shown in a failsafe mode in the "power on" locked position.
Figure 3:
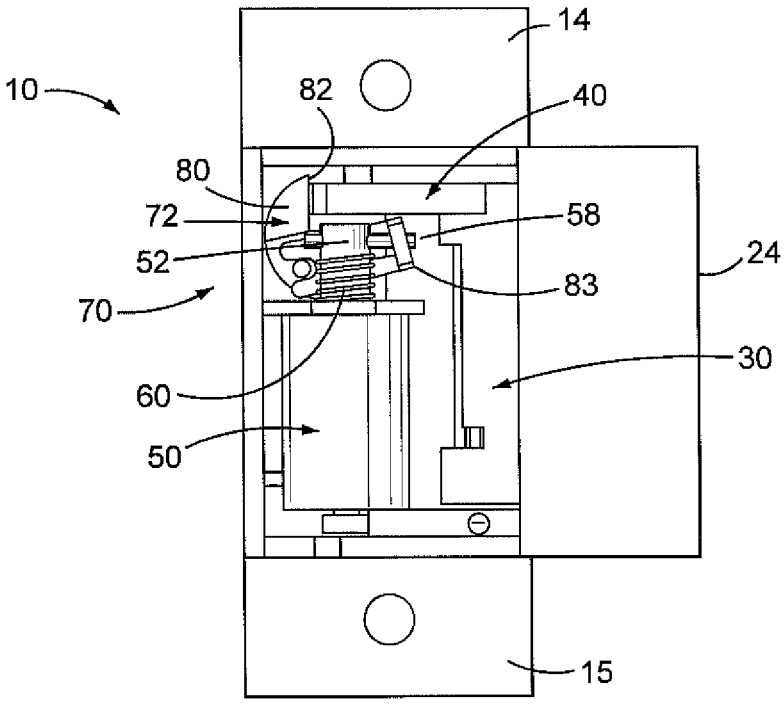
FIG. 3 is a view similar to FIG. 2 but illustrating the operation of the failsafe mode in a "power off" condition.
Figure 4:
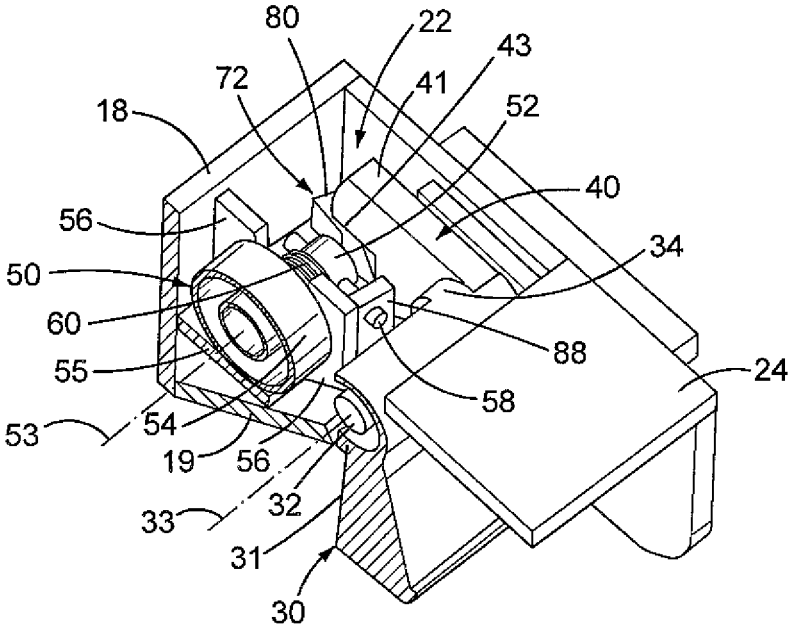
FIG. 4 is a partial isometric view, sectioned or cut-off on the line 4-4 in FIG. 2.

It will be seen from FIGS. 2 and 3 in particular, that the projecting segment 40 of the latch lies axially beyond the shaft of the electrically powered driver when the latter is extended and the latch is in its locking position.

Figure 8:
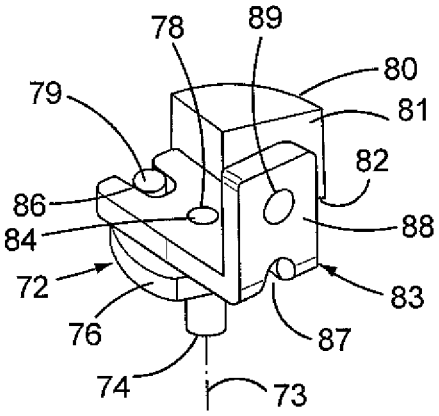
FIG. 8 is a further fragmentary view showing only the coupling member and the rotatable locking element in the mode and condition of FIGS. 1 and 6.
Figure 11:
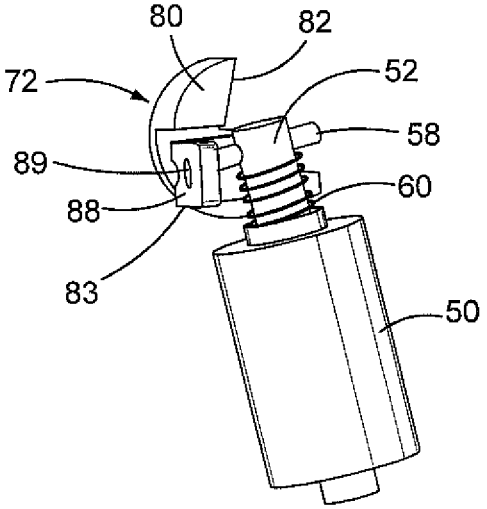
FIGS. 11 and 12 are views corresponding to FIGS. 7 and 8 for the fail-secure mode of FIGS. 9 and 10.
Figure 9:
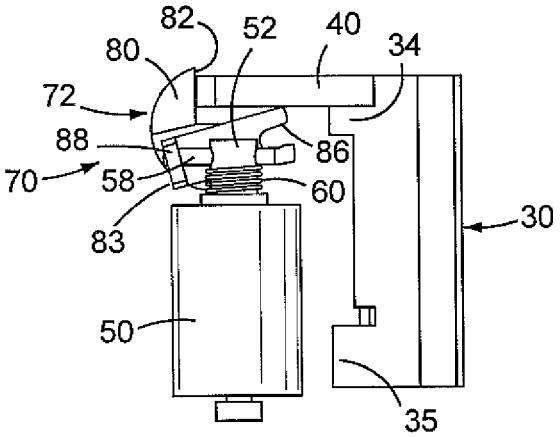
FIGS. 9 and 10 are fragmentary elevational views corresponding to FIGS. 2 and 3 but for the fail-secure mode and respectively in the "power on" and "power off" conditions.
Figure 12:
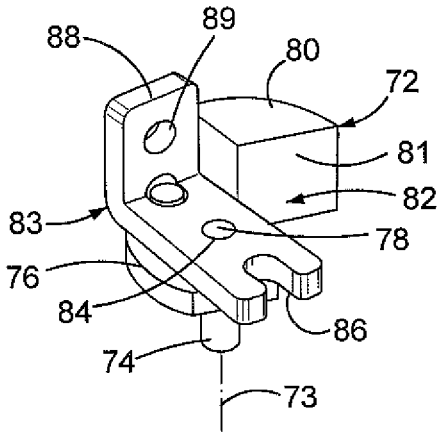

Mechanism 70 will now be described in greater detail. Rotatably mounted in a complementary recess at the front of chamber 22, but behind armature 52 when viewed from the rear (FIGS. 2 and 3), or relative to the plane of the hinge pin or latch axis 33 and the armature shaft or driver axis 53, is a locking element 72 best seen in FIGS. 6, 7, 8 and 12. Locking element 72 is an integral moulding with a mounting pin 74, a platen 76 atop the mounting pin with a pair of outstanding circular posts—post 78 is coaxial with pin 74 and the axis of rotation, and the second post 79 is adjacent the outer rim. Mounting pin 74 defines a lock axis 73 (FIGS. 1, 8 and 12) and mounts the locking element 72 for rotation about axis 73, which is normal to but offset from latch axis 33. Integrally outstanding from and upstanding from platen 76 is a land 80 with a radial edge face 81 that defines a recess 82: the rotational position of locking element 72 about the axis 73 of pin 74 determines whether the projecting wing 40 of latch 30 can move past edge face 81 (because recess 82 is in register with the projecting wing plate), thereby allowing the latch to move from its locking to its open position, or alternatively is blocked at a shoulder 43 by land 80 from so moving, whereupon the latch 30 is locked in its locking position.

Mechanism 70 further includes a coupling member 83 whereby the movement of armature 52 determines which of its two positions the locking element 72 occupies. Coupling member 83 (FIGS. 6, 7, 8 and 12) is a somewhat elongate, generally rectangular plate-like element that has a central hole 84 by which it pivotally engages on post 78, respective end slots 86,87 that are alternatively engageable with post 79, and, coincident with slot 87, an upstanding tab 88 with a central hole 89 that receives cross-pin 58 projecting from armature 52.

Coupling member 83 can be initially placed in, or later selectively switched between, two positions of substantially opposite orientation relative to the axis of armature shaft 52, in both cases disposed between the shaft and locking element 72 and operationally coupling the cross-pin 58 of the shaft to the locking element. The first position, illustrated in FIGS. 2, 3 and 6 to 8, has cross-pin 58 projecting to the right (that is, towards the latch axis) as viewed from the rear, and the coupling member 83 oriented so that (i) the upstanding tab 88 is adjacent the latch and receives the cross-pin 58 in hole 89, and (ii) the slot 86 at the other end of the coupling member is engaging the post 79 of the locking element. This is the failsafe mode. The solenoid is normally powered to draw in the solenoid shaft 52 and, via coupling member 83, to rotate locking element 72 to its locked position in which latch wing 40 is blocked and the door cannot be opened.

If the electrical power to solenoid 50 is now withdrawn, or the power to the mechanism otherwise fails, spring 60 drives the armature shaft outwardly and thereby rotates the locking element to the release position (FIG. 3) in which recess 82 is in register with latch wing 40. The latch is able to rotate back and the door can be opened.

Figure 10:
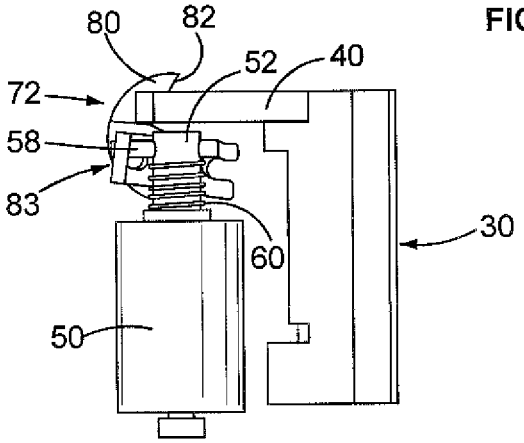

In the opposite orientation of coupling member 83 on its central mounting post 78, in which the armature shaft 52 is rotated through 180° so that the cross-pin 58 engages the hole 89 of tab 88 on the side away from latch 30, the mechanism is in fail-secure mode. This mode is illustrated in FIGS. 9 to 12. In this instance, the powered solenoid draws the locking element 72 to its release position (FIG. 9), enabling the door to be opened. On withdrawal of electrical power, or the unplanned failure of the electricity supply, the spring-biased extension of the solenoid armature 52 rotates the locking element 72 to the lock position, blocking the latch wing 40 (FIG. 10). In the event that the latch is in its retracted release position at the moment of power failure, appropriate canting of engaging edge faces of one or both of the latch wing and the locking element will allow the latch to push the locking element back temporarily as it rotates under the action of spring 36 back to its locking position, whereupon spring 60 will ensure that the locking element rotates back behind latch wing 40 to prevent subsequent release.

As already noted, the compact and elegant arrangement of latch 30, solenoid 50 and mechanism 70 within housing 12 allows the electric strike 10 to be dimensioned for mounting as an electric strike of standard sized non-electric-strike dimensions. It can therefore also be retrofitted in place of a standard sized non-electric strike.

It will be appreciated that the electrically powered driver 50, the locking element 72 and the coupling member 83 are disposed with chamber 22 hidden when the lock is viewed from within a doorway adjacent the jamb in which the strike is mounted.

The electric strike is selectively installed in failsafe or fail-secure mode, or easily changed in situ from one to the other, by setting both the appropriate orientation of coupling member 83 and the associated rotational position of armature shaft 52. The back cover must of course be removed to do this in situ.

An embodiment of the disclosure provides a compact electric strike capable, at least in one or more embodiments, of being retrofitted for a standard non-electric strike, and adaptable in one or more preferred forms to be easily configured in, or reconfigured between, fail-safe or fail-secure modes of operation.

Although the present disclosure has been described with reference to one or more examples, workers skilled in the art will recognize that changes may be made in form and detail without departing from the scope of the disclosure and/or the appended claims.

The invention claimed is:

1. An electrically powered lock comprising:

a housing that defines an outer recess and an interior chamber of the housing;

a latch mounted with respect to the housing in said outer recess so as to be pivotable about a latch axis between an open position and a locking position, and having a latch face and an integral projecting segment that extends into said chamber, projecting laterally of both the latch axis and the latch face;

a locking element mounted in said interior chamber for rotation about a lock axis normal to but offset from the latch axis for selectively blocking said integral projecting segment at a face of the locking element to hold the latch in said locking position or allowing the integral projecting segment to move past said face as the latch moves to said open position, to thereby place the lock respectively in a locked condition or an unlocked condition; and an electrically powered driver disposed within said housing laterally of said latch axis and having a shaft actuable along a driver axis in a direction generally parallel to the latch axis to effect said rotation of the locking element, wherein the projecting segment of the latch lies axially beyond the shaft of the electrically powered driver when said shaft is extended and the latch is in its locking position, and wherein the locking element is behind or below the shaft relative to a plane of the latch axis and the driver axis, and has a recess that registers with the projecting segment of the latch when allowing the latch to move to its open position but is rotatably displaceable to a position in which the locking element holds the latch in the locking position by blocking movement of the projecting segment.

2. An electrically powered lock according to claim 1 wherein the electrically powered lock is an electric strike.

3. An electrically powered lock according to claim 1, further including a coupling member operatively between the locking element and the electrically powered driver in said interior chamber, which coupling member is positionable in a first position or a second position, so that when the coupling member is in the first position the lock operates in a failsafe mode, and when in the second position the lock operates in a fail-secure mode.

4. An electrically powered lock according to claim 3 wherein the driver axis is generally parallel to the latch axis, and the shaft is actuable to move the locking element by being axially displaceable, and wherein the coupling member comprises an element disposed between said shaft and the locking element in engagement with an axially transverse projection on the shaft and with one or more outstanding formations on the locking element, wherein the aforesaid first position and the second position of the coupling member are substantially opposite orientations of the coupling member with respect to the aforesaid driver axis.

5. An electrically powered lock according to claim 1 wherein the shaft is aligned along the driver axis, generally parallel to the latch axis, and is actuable for moving the locking element by being axially displaceable.

6. An electrically powered lock according to claim 4 wherein the electrically powered driver is a solenoid and said shaft is an armature of the solenoid.

7. An electrically powered lock according to claim 4 wherein the shaft is biased to an extended position so that activation of the driver actuates the shaft by retracting the shaft from said extended position.

8. An electrically powered lock according to claim 7 wherein the shaft is biased to the extended position by a helical compression spring about said shaft.

9. An electrically powered lock according to claim 1 wherein the latch is pivotably mounted to the housing by a hinge pin extending the full length of the latch adjacent one edge of the latch face.

10. An electrically powered lock according to claim 9 wherein the latch is biased to the locking position.

11. An electrically powered lock according to claim 1 wherein the housing is dimensioned, and includes spaced flanges with appropriately located screw holes, for mounting the lock as an electric strike of standard sized non-electric strike dimensions.

12. An electrically powered lock comprising:

a housing;

a latch mounted with respect to said housing so as to be pivotable about a latch axis between an open position and a locking position and having a latch face and a projecting segment projecting laterally of both the latch axis and the latch face;

an electrically powered driver including a driver shaft aligned along a driver axis generally parallel to the latch axis, which driver is disposed within said housing laterally of said latch axis;

a locking element mounted for rotation about a lock axis normal to but offset from the latch axis for selectively holding the latch in said locking position or allowing the latch to move to said open position to thereby place the lock respectively in a locked condition or an unlocked condition; and a coupling member in engagement with an axially transverse projection on the shaft and with one or more outstanding formations on the locking element, which coupling member is positionable in a first position or a second position comprising substantially opposite orientations of the coupling member with respect to the driver axis, so that when the coupling member is in the first position the lock operates in a failsafe mode, and when in the second position the lock operates in a fail-secure mode, wherein the projecting segment of the latch lies axially beyond the shaft of the electrically powered driver when said shaft is extended and the latch is in its locking position, and wherein the locking element is behind or below the shaft relative to a plane of the latch axis and driver axis, and has a recess that registers with the projecting segment of the latch when allowing the latch to move to its open position but is rotatably displaceable to a position in which the locking element holds the latch in the locking position by blocking movement of the projecting segment;

wherein said driver is actuable along the driver axis to effect said rotation of the locking element via said coupling member.

13. An electrically powered lock according to claim 12 wherein the electrically powered lock is an electric strike.

14. An electrically powered lock according to claim 12 wherein the electrically powered driver is a solenoid and said shaft is an armature of the solenoid.

15. An electrically powered lock according to claim 12 wherein the shaft is biased to an extended position so that activation of the driver actuates the shaft by retracting the shaft from said extended position.

16. An electrically powered lock according to claim 15 wherein the shaft is biased to the extended position by a helical compression spring about said shaft.

17. An electrically powered lock according to claim 12 wherein the electrically powered driver, the locking element and the coupling member are disposed within a chamber hidden when the lock is viewed from within a doorway adjacent the jamb in which the lock is mounted.

18. An electrically powered lock according to claim 12 wherein the latch is pivotably mounted to the housing by a hinge pin extending the full length of the latch adjacent one edge of the latch face.

19. An electrically powered lock according to claim 18 wherein the latch is biased to the locking position.

20. An electrically powered lock according to claim 12 wherein the housing is dimensioned, and includes spaced flanges with appropriately located screw holes, for mounting the lock as an electric strike of standard sized non-electric strike dimensions.

21. An electrically powered lock according to claim 1 wherein the electrically powered lock is an electric strike.

22. An electrically powered lock according to claim 4 wherein the electrically powered lock is an electric strike.

23. An electrically powered lock according to claim 3 wherein the electrically powered driver includes a shaft aligned along a driver axis generally parallel to the latch axis, and actuable for moving the locking element by being axially displaceable.

24. An electrically powered lock according to claim 23 wherein the electrically powered driver is a solenoid and said shaft is an armature of the solenoid.

25. An electrically powered lock according to claim 23 wherein the shaft is biased to an extended position so that activation of the driver actuates the shaft by retracting the shaft from said extended position.

26. An electrically powered lock according to claim 1 wherein the housing is dimensioned, and includes spaced flanges with appropriately located screw holes, for mounting the lock as an electric strike of standard sized non-electric strike dimensions.

27. An electrically powered lock according to claim 4 wherein the housing is dimensioned, and includes spaced flanges with appropriately located screw holes, for mounting the lock as an electric strike of standard sized non-electric strike dimensions.

28. An electrically powered lock according to claim 14 wherein the electrically powered lock is an electric strike.

29. An electrically powered lock according to claim 12 wherein the electrically powered lock is an electric strike.

30. An electrically powered lock according to claim 12 wherein the electrically powered driver, the locking element and the coupling member are disposed within a chamber hidden when the lock is viewed from within a doorway adjacent the jamb in which the lock is mounted.

31. An electrically powered lock according to claim 1, wherein said face of the locking element ends at an edge and said latch moves past the edge to said open position.

32. An electrically powered lock according to claim 3, wherein as the locking element rotates said face of the locking element moves laterally from the path of travel of the integral projecting segment to allow the segment to move past said edge.

33. An electrically powered lock according to claim 3, wherein said edge defines a recess in the locking element into which the integral projecting segment moves as it moves to said open position of the latch.

34. An electrically powered lock according to any one of claims 1, wherein the electrically powered driver is disposed within said interior chamber, and the chamber is hidden when the lock is viewed from within a doorway adjacent the jamb in which the lock is mounted.

35. An electrically powered lock according to claim 1, wherein the electrically powered driver is coupled to the locking element to effect said rotation of the locking element.

* * * * *